United States Patent [19]

Mark

[11] Patent Number: 4,690,242

[45] Date of Patent: Sep. 1, 1987

[54] SOUND ACTUATED SWITCH

[76] Inventor: David S. Mark, 194 Sagamore, San Francisco, Calif. 94112

[21] Appl. No.: 932,730

[22] Filed: Nov. 19, 1986

[51] Int. Cl.[4] ..... H01H 35/24

[52] U.S. Cl. ..... 181/0.5; 200/61.01; 200/DIG. 20; 307/117; 362/802; 381/110; 381/205

[58] Field of Search ..... 181/0.5, 139; 367/140, 367/141, 158, 170, 173; 200/61.01, DIG. 20; 307/116, 117, 400; 381/110, 191, 123, 156, 169, 188, 205; 362/276, 802; 340/540, 566, 690, 565

[56] References Cited

U.S. PATENT DOCUMENTS

| | | | |
|---|---|---|---|
| 1,279,831 | 9/1918 | Berger | 446/175 |
| 2,161,416 | 6/1939 | Herb et al. | 200/52 |
| 2,396,699 | 3/1946 | Hayes et al. | 200/52 |
| 2,853,677 | 9/1958 | Daschke | 324/80 |
| 3,001,177 | 9/1958 | Adler | 340/171 |
| 3,119,201 | 5/1962 | Brown et al. | 46/245 |
| 3,286,126 | 11/1966 | Crawford | 315/159 |
| 3,444,646 | 9/1966 | Domashoretz | 46/244 |
| 3,458,950 | 8/1969 | Tomaro | 46/243 |
| 3,536,836 | 10/1970 | Pfeiffer | 179/1 |
| 3,538,639 | 11/1970 | Tomaro | 46/232 |
| 4,006,318 | 2/1978 | Sebesta et al. | 381/188 X |
| 4,122,445 | 10/1985 | Orita | 340/566 |
| 4,194,194 | 3/1980 | Redfern | 340/566 |
| 4,434,329 | 2/1984 | Nasu | 179/121 |
| 4,442,323 | 4/1984 | Yoshidei et al. | 179/110 |
| 4,453,046 | 6/1984 | Fidi et al. | 179/146 |
| 4,511,768 | 4/1985 | Patel | 179/146 |
| 4,571,583 | 2/1986 | Giordano | 340/692 |
| 4,584,702 | 4/1986 | Walker, Jr. | 351/71 |

*Primary Examiner*—Deborah L. Kyle
*Assistant Examiner*—John E. Griffiths
*Attorney, Agent, or Firm*—Karon, Morrison & Savikas

[57] ABSTRACT

A sound actuated detector comprising a microphone, an elastic cylinder having a flexible bottom adapted to fit tightly around the microphone with the sensing surface of the microphone fitting tightly against the flexible bottom, a mounting base connected to the surface of the cylinder having the flexible bottom, an elastic isolating medium arranged between the base and the surrounding surface to which the detector is attached, and a weight connected to the microphone having a mass such as to eliminate movement of the microphone in response to frequencies above a selected frequency.

7 Claims, 3 Drawing Figures

SOUND ACTUATED SWITCH

BACKGROUND OF THE INVENTION

This invention relates to switching arrangements and, more particularly, to switching arrangements operable in response to particular frequencies of sound.

There has long been a need for detectors capable of sensing particular sounds (or more broadly, vibration frequencies). Such detectors have been used for a great number of purposes including among other things vibrationally actuated devices for sensing intruders, acoustically actuated switches, sound controlled toys, and sound actuated lights.

Although many such detectors exist, no economically feasible device exists for use with non-metallic lamp fixtures. Moreover, the call for more advanced automation features has exposed problems in automatic control arrangements. For example, the automatic detectors used with sound actuated lights have been found to respond to a great many extraneous vibrations which, in effect, render the devices useless. Many such devices respond to rumblings caused by heavy vehicles, to footsteps, room sounds, and to any number of other local sounds.

SUMMARY OF THE INVENTION

It is, therefore, an object of this invention to provide an improved detection device for automatic control arrangements which does not respond to the general level of ambient mechanical frequencies.

It is another object of this invention to provide a sound actuated controller for switching circuitry within a particular area.

It is another object of this invention to provide a non-conductive light fixture which may be actuated between any of a number of states of operation by mechanical vibrations but is insensitive to the normal ambient vibrations.

These and other objects of the invention are accomplished by a sound actuated detector having a microphone with a sensing surface, an elastic cylinder having a flexible bottom, the cylinder being adapted to fit tightly around the microphone with the sensing surface of the microphone fitting tightly against the flexible bottom, a mounting base connected to the surface of the cylinder having the flexible bottom, and an inertial mass affixed to the microphone adapter and arranged to distort the surface of the cylinder and the flexible bottom in response to mechanical vibrations of selected frequencies.

Other objects, features, and advantages of the invention will become apparent upon reference to the specification taken in conjunction with the drawings in which like elements are referred to by like reference characters throughout the several views.

DESCRIPTION OF THE PREFERRED EMBODIMENT

Figure 1:
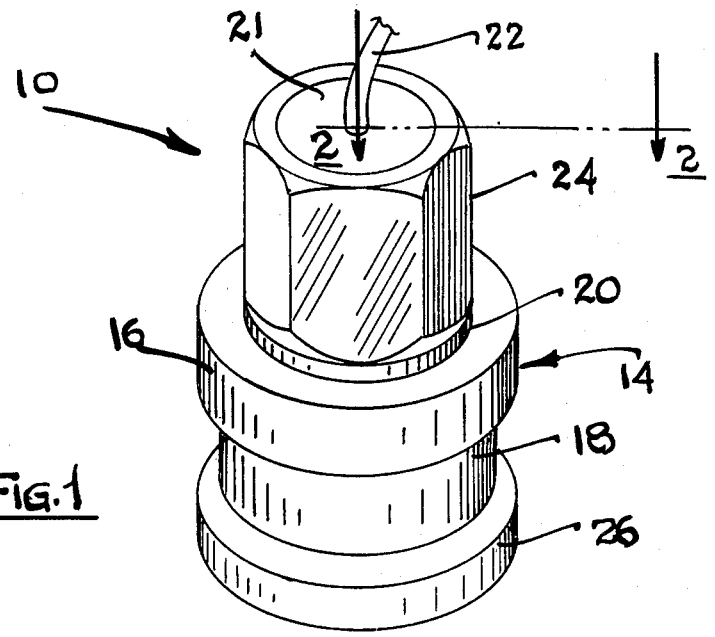
FIG. 1 is a perspective view of a sound actuated detector constructed in accordance with the invention.
Figure 2:
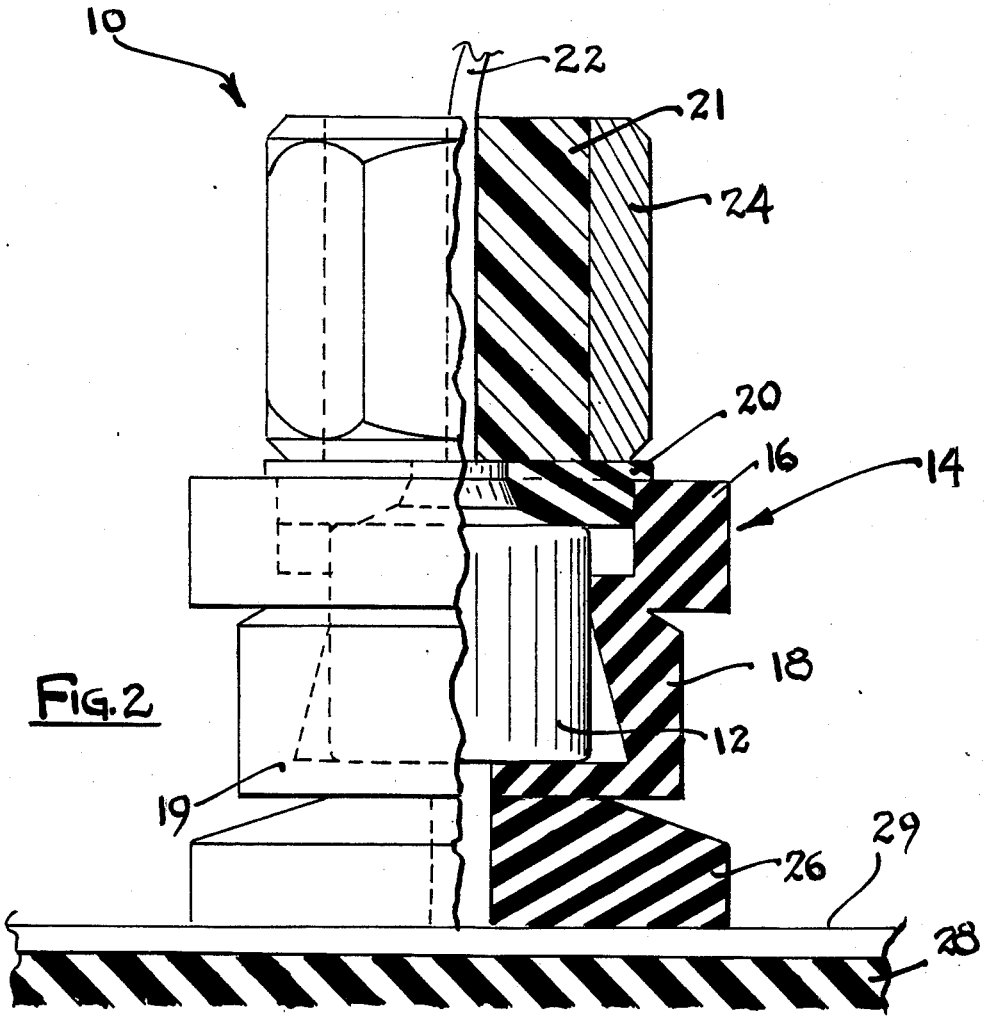
FIG. 2 is a cross-sectional view taken along lines 2—2 of FIG. 1 showing an internal view of the invention.

Referring now to FIGS. 1 and 2 there is shown a sound actuated detector 10 constructed in accordance with the invention. The detector comprises a microphone 12 which in the preferred embodiment may be an electret microphone element. The microphone 12 contains a piezoelectric membrane which stimulates an internal amplifier when the membrane encounters rapid changes in air pressure. In a preferred embodiment, an Archer electret condenser microphone element, sold by Tandy Corporation as catalog no. 270-092B is utilized.

The microphone 12 has a cylindrical exterior which resides in and is tightly held in place by an elastic cylinder 14 which has an upper portion 16 and a lower portion 18. In the preferred embodiment, the cylinder 14 is made of a flexible rubber or neoprene material. The interior of the lower portion 18 has a first diameter adapted to fit tightly about the cylindrical exterior of the microphone 12 and a flexible bottom 19. The upper portion of the cylinder 14 has a larger diameter adapted to receive an elastic cap 20 which in the preferred embodiment is made of a flexible rubber or neoprene material. The cap 20 may be held in place by an adhesive such as a silicon glue (not shown in the figures), and a pair of wires 22 which are connected to the microphone 12 project therethrough. The cap 20 is also sealed at 21 where the wires 22 project so that the microphone 12 is hermetically sealed within the enclosure provided by the cylinder 14 and the cap 20.

Affixed to the cap 20 is an inertial mass 24 which may be selected to provide an appropriate frequency range for the detector of this invention. In the preferred embodiment, the mass 24 may be constructed of a material (such as brass, lead, or iron) having a relatively high specific gravity. Affixed to the bottom of the cylinder 14 is an elastic mounting base 26 which is made of rubber or neoprene in the preferred embodiment. Each of the base 26 and the mass 24 may be affixed to the cylinder 14 and the cap 20, respectively, by a well known adhesive. The base 26, in turn, may be affixed to the device which is to be monitored for acoustic frequencies.

As may be best visualized from the drawing of FIG. 2, when a device which is to respond to acoustical frequencies has a detector 10 mounted on it (for example when a detector 10 is mounted within the base of a lamp) and the device receives mechanical vibrations, the large weight of the mass 24 acts to amplify vibrations within a frequency range determined by the characteristics of the elastic compounds of which the cylinder 14, the cap 20, and the base 26 are constructed, the shape and dimensions of those elements, and the weight of the mass 24. In general, the greater the mass 24, the lower the range of frequencies to which the mass responds. Furthermore, the greater the mass, the more sensitive the transducer is to all frequencies between approximately 10 and 1500 Hz, with the lower frequencies being further enhanced as the mass increases. An optimum weight for the mass 24 appears to be fifteen grams. Tests of a preferred embodiment which is approximately one and one-half inches tall show that a fifteen gram mass 24 is five times as sensitive to low frequencies as is a four gram mass 24.

It is believed that isolating the microphone 12 within a flexible enclosure drastically reduces its normal sensitivity to vibrations, especially those carried through the air. In fact, without a mass 24, the detector 10 in a preferred embodiment responds only to frequencies of approximately 1500 Hz. Adding a mass 24 greater than 2.5 grams doubles the response at this frequency and provides a response range of approximately 10–2000 Hz. The reason for this new response range seems to be that as the mass 24 begins to move with the acoustical vibrations, the narrow waist formed by the decreasing cross-sectional area of the base 26 where the cylinder 14 and the base 26 meet tends to distort, distorting the elastic membrane which is the flexible bottom 19 of the cylinder 14 and forms the wall against which the microphone sensing element lies. This distortion of the elastic membrane 19 with respect to the surface of the microphone 12 causes the trapped air to flex the surface of the microphone 12 and generates a signal which may be detected, amplified, and utilized for switching purposes in the preferred embodiment of the invention.

More particularly, when the detector 10 is utilized in a lamp base, vibrations caused by tapping the base are sensed by the detector 10. The mass 24 moves in response to those vibrations distorting the cylinder 14 and its elastic membrane bottom 19 with respect to the microphone 12. This movement of the mass 24 moves the membrane 19 with respect to the surface of the microphone 12 generating a signal which is sent by the conductors 22 to a detector and amplifier circuit 30 for changing the condition of the light.

In the preferred embodiment, the light may have two or more active states. For example, the light may be off, on in a low state, on in a middle state, and on in a higher state of illumination.

If it is desirable to isolate the detector 10 from ambient mechanical frequencies such as rumbling caused by trucks, the slamming of doors, table knocking or pounding, and the like, a relatively soft elastic material 28 may be used between the base 29 of the lamp or the device in which vibrations are to be detected and whatever that device is arranged upon. The use of such a soft elastic material between the device at which vibrations are to be detected and its surroundings reduces the amplitude of mechanical vibrations from those surroundings and allows the device to respond to mechanical vibrations of the device itself.

Figure 3:
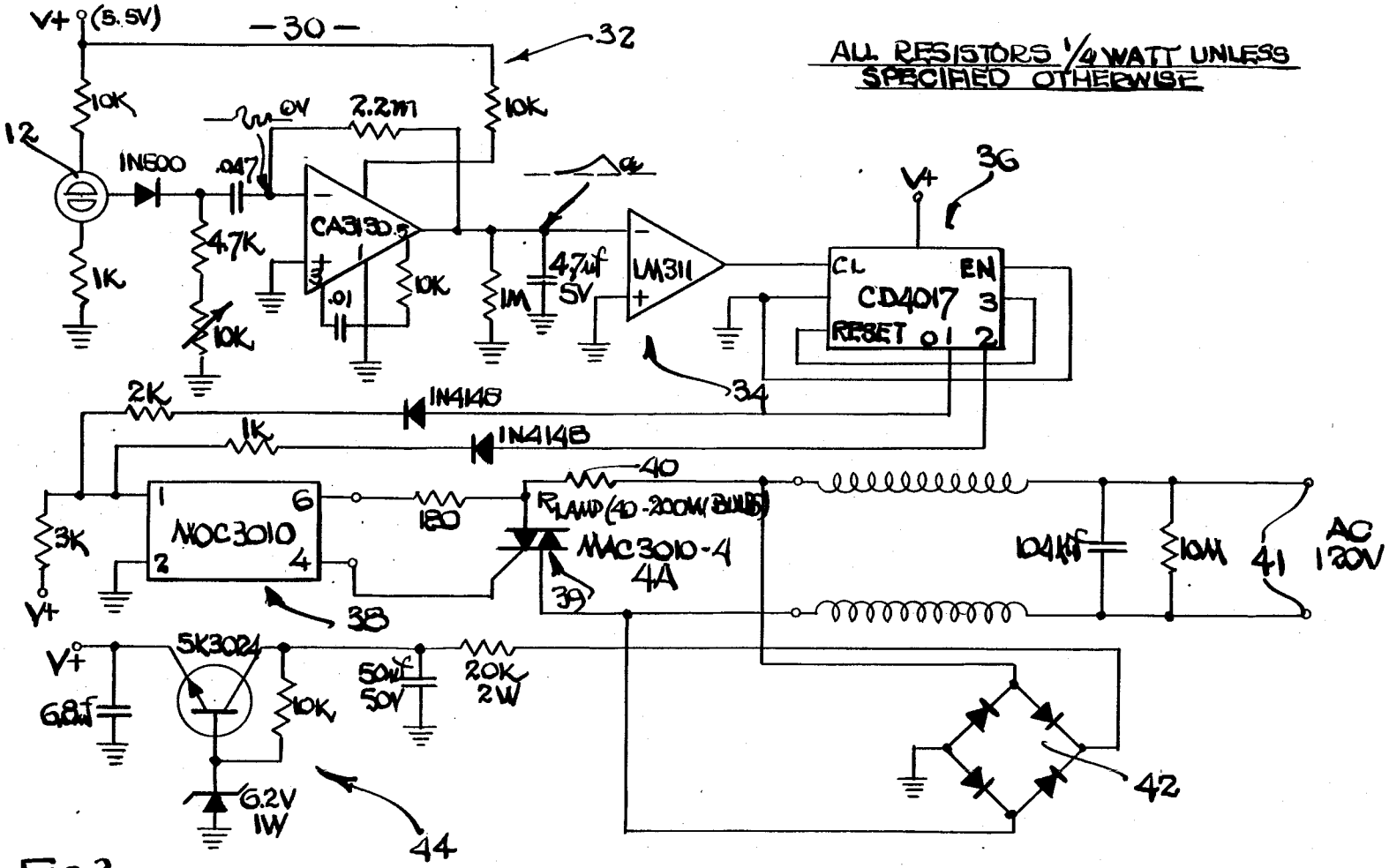
FIG. 3 is a schematic diagram of a circuit constructed in accordance with the invention which may be utilized with the detector shown in FIG. 1.

Referring to FIG. 3, there is shown a circuit diagram for an amplifier and detecting circuit 30 which may be utilized with the detector 10 of the present invention for providing signals which may be utilized for purposes such as changing the condition of a lamp. The circuit 30 has a first amplifier portion 32 which is directly connected to receive A.C. signals generated by the electret microphone 12. A variable resistor therein allows the base amplitude level at which vibrations affect the circuit 30 to be varied. These signals are amplified and transferred by means of a low pass filter section 33 which produces a ramp function signal to a comparator portion 34 which responds to positive input to produce an amplified output pulse. This pulse drives a switcher portion 36 which acts as a flip-flop circuit to provide a constant signal (either "on" or "off" depending on the state of the switcher 36 at receipt). This constant value signal is transferred from the low voltage side of the circuit 30 by an opto-coupler circuit 38 to provide a signal for biasing a triac 39 and switching the condition of a lamp 40 of the preferred embodiment.

The circuit 30 of FIG. 3 also includes a power supply portion 41 for providing A.C. power to operate the triac 39. A bridge circuit 42 is connected across the power supply 41 for operating a circuit 44 for providing low voltage power to operate low voltage portion of the circuitry. All of these circuit elements are constructed in a manner well known to the prior art and are, therefore, not discussed in detail here.

As will be understood by those skilled in the art, various arrangements other than those described in detail in the specification will occur to those persons skilled in the art which arrangements lie within the spirit and scope of the invention. For example, since the detector 10 is sealed, it could be used to detect vibrations in water or other liquid or be placed in the ground for detection purposes. It is therefore to be understood that the invention is to be limited only by the claims appended hereto.

What is claimed is:

1. A sound actuated detector comprising a microphone, a cylinder having a flexible membrane perpendicular to its axis, the cylinder being adapted to fit tightly around the microphone with the sensing surface of the microphone fitting tightly against the flexible membrane, means for affixing the cylinder to a surface at which sound is to be detected, and a weight connected to the cylinder having a mass such as to distort the flexible membrane of the cylinder in response to frequencies in a selected range.

2. A sound actuated detector as claimed in claim 1 further comprising means for hermetically sealing the microphone within the cylinder.

3. A sound actuated detector as claimed in claim 1 in which the cylinder is made of an elastic material.

4. A sound actuated detector as claimed in claim 1 in which the means for affixing the cylinder to a surface comprises an elastic base attached to the flexible membrane.

5. A sound actuated detector as claimed in claim 4 in which the elastic base has a smaller cross section at the surface which is attached to the flexible membrane than its general cross section.

6. A sound actuated detector as claimed in claim 1 further comprising means for isolating the surface at which sound is to be detected from its surroundings.

7. A sound actuated detector as claimed in claim 6 in which the means for isolating the surface from its surroundings comprises an elastic material arranged between the surface and its surroundings.

* * * * *